United States Patent [19]

Hatanaka

[11] Patent Number: 4,690,340

[45] Date of Patent: Sep. 1, 1987

[54] WASTE MATERIAL SHREDDER

[76] Inventor: Takefumi Hatanaka, No. 1-4-13, Midori-cho, Koganei-shi, Tokyo, Japan

[21] Appl. No.: 880,638

[22] Filed: Jun. 27, 1986

Related U.S. Application Data

[63] Continuation of Ser. No. 689,272, Jan. 7, 1985, abandoned, which is a continuation-in-part of Ser. No. 465,969, Feb. 14, 1983, abandoned.

[30] Foreign Application Priority Data

Feb. 12, 1982 [JP] Japan ..... 57-17236
Jul. 19, 1982 [JP] Japan ..... 57-125582

[51] Int. Cl.[4] ..... B02C 13/20
[52] U.S. Cl. ..... 241/236; 241/293
[58] Field of Search ..... 241/166, 236, 293, 294

[56] References Cited

U.S. PATENT DOCUMENTS 4,260,115 4/1981 Hatanaka ..... 241/236

FOREIGN PATENT DOCUMENTS 2318010 10/1973 Fed. Rep. of Germany ..... 241/294
2614998 10/1977 Fed. Rep. of Germany ..... 241/236

*Primary Examiner*—Howard N. Goldberg
*Assistant Examiner*—Joseph M. Gorski
*Attorney, Agent, or Firm*—Jordan and Hamburg

[57] ABSTRACT

A waste material shredder having a pair of counter-rotating cutter rollers with mutually meshing cutter disks mounted thereon, and fixed spacer members separating the cutter disks. Sheets of waste material are shredded into small chips by the action of sharp protruding teeth on the cutter disks which punch transverse slits and by subsequent shearing action between adjacent opposing cutter disks. Jamming of the shredder due to build-up of chips between the spacers is eliminated by a special configuration of the cutter disks, with chip clearance protrusions being formed between the teeth which act to completely remove the cut chips from the shredder, thereby overcoming a basic problem with prior art "cross-cut" type shredders.

8 Claims, 4 Drawing Figures

WASTE MATERIAL SHREDDER

This is a continuation application of U.S. Ser. No. 689,272, filed Jan. 7, 1985, now abandoned, said Ser. No. 689,272 being a continuation-in-part application of U.S. Ser. No. 465,969 filed Feb. 14, 1983, now abandoned.

BACKGROUND OF THE INVENTION

Various types of waste material shredder are in use at the present time. These are used primarily for shredding documents in order to destroy the information content therein. However various other materials may be subjected to shredding, such as for example computer punch cards, printed circuit substrates, etc. Such waste material shredder can be broadly divided into two types, i.e. strip type shredders and cross-cut shredders. The strip type shredders act to cut sheets of waste material into elongated longitudinal strips, by a shearing action, while the cross-cut shredders cut the sheets of waste material into small chips, or very short strips. From the aspect of maximum destruction of any information contained in the waste material, and for minimizing the volume of the shredded output material, the cross-cut type of shredder is preferable. However a major problem which has arisen with prior art types of cross-cut shredder is that the shredded chips produced by the shredder tend to gradually accumulate within the mechanism, over a period of time, and to eventually cause the mechanism to be jammed, so that it becomes necessary for the user to periodically clear out such blockages from the shredder. This is extremely inconvenient, and is a major disadvantage of prior art cross-cut shredders by comparison with the mechanically simple strip type shredders.

More specifically, a cross-cut shredder generally comprises a pair of rotating shafts with their axes of rotation parallel to one another, with sets of cutter disks fixedly mounted on each shaft, and mutually meshing. Spacer members are fixedly mounted between the cutter disks of each shaft, to maintain a fixed separation between the cutter disks, and teeth are formed on the peripheries of the cutter disks. When such a shredder is operated over a long period of time, the shredded chips which are produced by a cutting action of the teeth and shearing between the cutter disks are not entirely removed from the mechanism, and gradually accumulated between the spacer members. As time elapses, this accumulation will increase to such an extent that the cutter disks can no longer rotate, and so the chips must be cleared out by the user.

With a waste material shredder according to the present invention, a special configuration for the cutter disks is employed, whereby the shredded chips are completely removed from the cutter mechanism immediately after they are produced, so that the problem described above is entirely eliminated. Thus a waste material shredder according to the present invention presents substantial advantages over prior art shredders with respect to ease of maintenance and reliability of operation.

SUMMARY OF THE DISCLOSURE

A waste material shredder according to the present invention is of the cross-cut shredder type discussed above, comprising a pair of counter-rotating cutter rollers disposed side by side, with the axes of rotation of these cutter rollers being parallel to one another, each cutter roller comprising a roller shaft with a set of cutter disks fixedly mounted coaxially thereon, and with the cutter disks of one cutter roller meshing with the cutter disks of the other cutter roller in a successively alternating manner. Fixedly mounted spacer plates are disposed between pairs of cutter disks on each cutter roller, to thereby maintain a fixed separation between the cutter disks. Each of the cutter disks is formed with a plurality of pairs of closely adjacent protrusions formed at regular spacings around the disk periphery, with each pair consisting of a chip clearance protrusion and a cutter tooth, the cutter tooth having a sharp cutting edge and the chip clearance protrusion being of blunt contour and positioned leading the cutter tooth with respect to the direction of rotation of the disk. The cutter teeth serve to penetrate into sheets of material being shredded, to form lateral slits, and this action is combined with a shearing action occurring between the opposing enmeshed cutter disks to produce cross-cutting of the sheets. The chip clearance protrusions serve to position the sheets in an optimum manner to facilitate the latter penetration by the cutter teeth, and also to effectively remove the chips of waste material formed by the cutting action, to prevent the chips from becoming jammed within the cutting mechanism. The basic reason for the problem of shredded chips building-up inside the mechanism of a cutter disk shredder is that, in general, some form of punching action is imparted by the cutter disk teeth in order to perform cross-cutting of the waste material sheets, in addition to the longitudinal shearing action. This punching action, which cuts the material transversely, causes a certain amount of deformation of the waste material, and it is because of this deformation that the chips tend to become retained between the spacer members which separate the cutter disks. However the clearance protrusions of the cutter disks of a waste material shredder according to the present invention perform a "sweeping" action, whereby the shredded chips are, so as to speak, "floated" out from between the spacer members, so that the problem of chip build-up in the mechanism is very effectively overcome.

DESCRIPTION OF THE PREFERRED EMBODIMENTS

Figure 1:
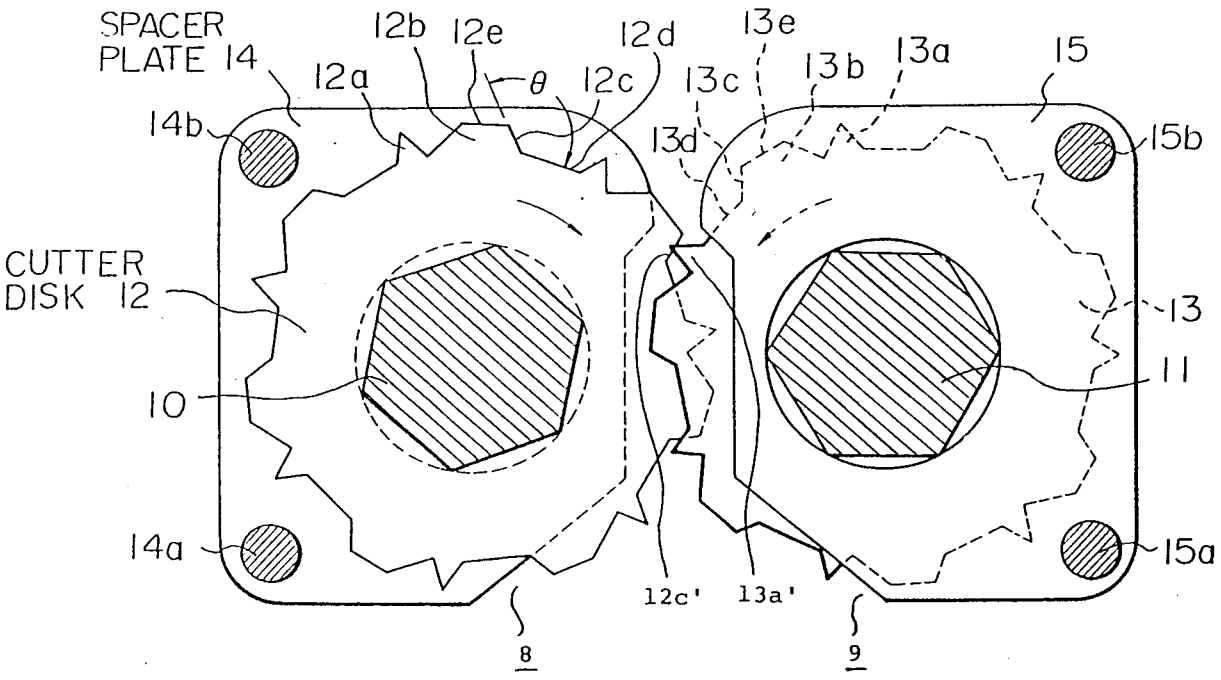
FIG. 1 is a cross-sectional view of the cutter roller and spacer plates of an embodiment of a waste material shredder according to the present invention, taken in a plane perpendicular to the longitudinal axes of the cutter rollers.
Figure 2:
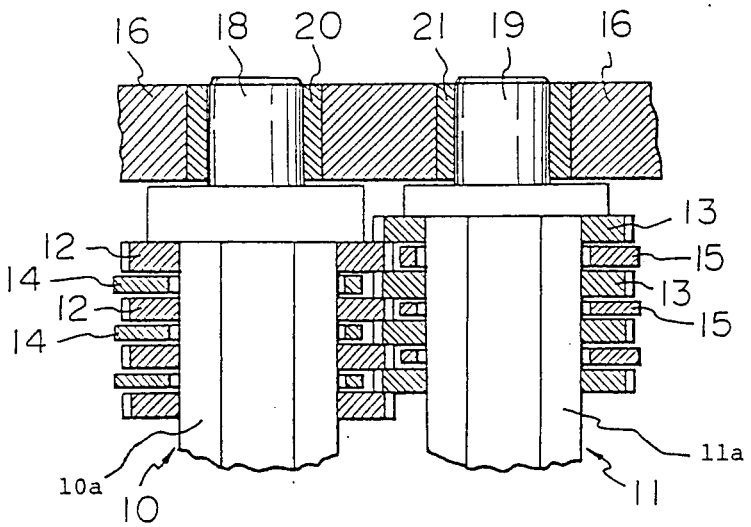
FIG. 2 is a partial cross-sectional view in plan of the cutter rollers and spacer plates of the embodiment of FIG. 1.

Referring now to the drawings, FIG. 1 shows a cross-sectional view of the cutter rollers and spacer plates of an embodiment of a waste material shredder according to the present invention, as seen along the longitudinal axes of the cutter rollers, while FIG. 2 is a partial cross-sectional view in plan of these cutter rollers and spacer plates. The drive means for rotating the cutter roller and the means for directing sheets of waste material to be cut are not shown in the drawings. Numerals 10 and 11 denote a pair of roller shafts of a pair of cutter rollers 8 and 9 respectively, which are rotatably mounted at ends 18 and 19 in bearings 20 and 21 respectively, and rotate in opposite directions to one another. The cutter rollers 8 and 9 are mounted adjacent to one another with their longitudinal axes aligned parallel to one another. Numeral 12 collectively designates a set of cutter disks which are mounted on roller shaft 10, and numeral 13 denotes a set of cutter disks which are fixedly mounted on roller shaft 11. Numeral 14 collectively designates a set of spacer plates which are fixedly attached to supporting member 16 ( and an opposing supporting member, not shown in the drawings ) by longitudinal members 14*a* and 14*b* with the spacer plates 14 and cutter disks 12 being arranged in an alternating manner as shown, so that each pair of cutter disks is separated by a spacer plate.

Similarly, a set of cutter disks 13 are fixedly mounted on roller shaft 11, and alternate with spacer plates 15. The cutter disks 12 of cutter roller 8 mesh with cutter disks 13 of cutter roller 9, as shown.

Cutter disks 12 and 13 are restrained from rotating with respect to roller shafts 10 and 11 by providing a hexagonal cross-section external contour on mounting portions 10*a* and 11*a* of roller shafts 10 and 11 respectively, and providing corresponding hexagonal apertures in cutter disks 12 and 13 for mounting on the shafts, as shown in FIG. 1. Circular apertures are formed in the spacer plates 14 and 15, having a diameter which is slightly greater than the circumscribing circle of the hexagonal cross-sectional contour of roller shafts 10 and 11, since the spacer plates are held stationary.

Each of the rotating cutter disks 12 and 13 has a plurality of pairs of protrusions formed at regular spacings about the periphery thereof, each pair comprising a cutter tooth and a chip clearance protrusion positioned closely adjacent to one another, e.g. the pair formed by cutter tooth 12*a* and chip clearance protrusion 12*b* on cutter disk 12 in FIG. 1, and the pair formed by chip clearance protrusion 13*b* and cutter tooth 13*a* on cutter disk 13. Each chip clearance protrusion is preferably formed with a profile having a sloping leading edge ( e.g. as indicated by 12*c*) whose profile forms an obtuse angle with the profile of the preceding portion of the periphery, e.g. angle $\theta$ in FIG. 1. This sloping leading edge of each chip clearance protrusion is important for the operation of the apparatus, as described in detail hereinafter. The overall shape of each chip clearance protrusion is blunt, as viewed in profile, i.e. the chip clearance protrusion do not perform a penetration function during shredding, this function being carried out entirely by the cutter teeth. In this embodiment, the chip clearance protrusions each have a profile ( as viewed along the direction of rotation of a disk ) in the form of three sides of a trapezoid, with one of these sides being the sloping leading face referred to above. As shown in FIG. 1, the chip clearance protrusions and the cutter teeth of each cutter disk protrude radially outward from a common pitch circle. The maximum extent of this radial protrusion of the chip clearance protrusions on a cutter disk must not exceed the maximum amount of radial protrusion of the cutter teeth on that cutter disk.

Each chip clearance protrusion in a pair of protrusions is positioned to lead the cutter tooth of that pair, with respect to the direction of rotation of the cutter disk on which the protrusions are formed. It is an essential feature of the present invention that the angular position of the roller shafts are precisely arranged such that, as indicated in FIG. 1, as the two roller shafts counter-rotate, each cutter tooth on a cutter disk successively approaches two chip clearance protrusions respectively formed on the two opposing cutter disks which are positioned on each side of the first-mentioned cutter disk and are closely adjacent to or in sliding contact with that cutter disk, then the tip portion of that cutter tooth momentarily overlaps ( as viewed along the direction of rotation of the cutter rollers ) the leading faces of these opposing chip clearance protrusions at a position close to the central region of each face, i.e. that tip portion momentarily protrudes slightly between these leading faces of the adjacent opposing chip clearance protrusions. This condition has just been attained, for example, by cutter tooth 13*a*′ in FIG. 1, with respect to the opposing chip clearance protrusion leading face 12*c*′.

In the present embodiment, the cutter teeth have a sharp chisel shape, which is triangular as viewed in cross-section as seen in FIG. 1. In other words, each of the cutter teeth has a laterally extending cutting edge, which perforates the sheets of waste material with a very low amount of resistance to that perforation, as described in greater detail hereinafter.

Each of the chip clearance protrusions has a trapezoidal shape as viewed in cross section, in the present embodiment, as seen in FIG. 1. It is an essential feature of the present invention that leading face of each of the chip clearance protrusions (i.e. the face which reaches the waste material immediately after a preceding cutter tooth, as the corresponding cutter disk rotates ) forms an oblique angle with a face that is substantially tangential to the periphery of the cutter disk. Thus in the present embodiment, the leading face 12*c* of cutter disk 12 forms an oblique angle $\theta$ with the tangential face 12*d*.

Figure 3:
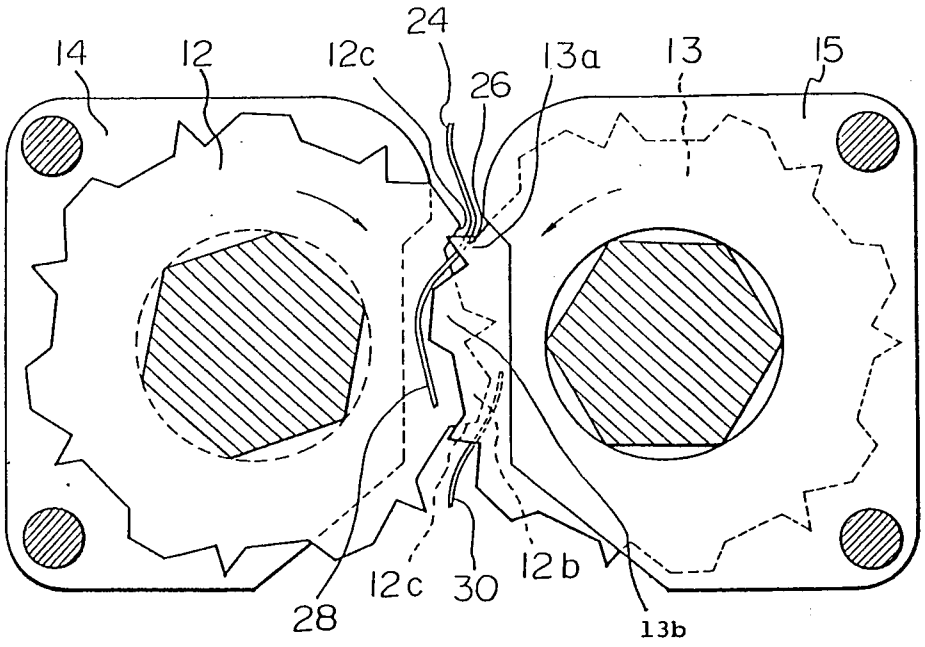
FIG. 3 is a cross-sectional view of the cutter rollers and spacer plates of the embodiment of FIG. 1, illustrating the cutting action applied to a sheet of waste material.

The meshing relationship between the sets of cutter disks 12 and 13 of cutter rollers 8 and 9 can be clearly understood from FIG. 2. The cutting operation of the present embodiment will now be described in more detail, referring to FIG. 3. The operation will be described with reference to a single cutter tooth 13*a* on one cutter roller and two chip clearance protrusions ( collectively indicated as 12*b*) respectively formed on the two immediately adjacent cutter disks on the opposing cutter roller. Numeral 24 denotes a sheet of waste material which is to be shredded, and which is inserted vertically from the top downward, as viewed in the drawing, between the sets of cutter rollers 8 and 9. The sheet is directed by the shape of the upper portions of spacer plates 14 and 15 to be drawn by the action of mutually meshing sets of cutter disks 12 and 13. The waste material sheet first meets the leading sloping faces 12*c* of chip clearance protrusions 12*b* of cutter disks 12, then a lateral slit perforation is formed in the sheet by cutter tooth 13*a*, as that cutter tooth moves into a position slightly overlapping the two leading faces 12*c* as described hereinabove. It can thus be clearly understood that this momentary overlapping relationship between the cutter tooth tip and the leading faces of the opposing chip clearance protrusions ensures highly efficient penetration of the waste material sheet by the cutter tooth, by positioning the sheet such that a slit 26 is cut in the sheet with a very low level of resistance to this perforation. Next, as a result of the meshing relationship of the cutter disks, a shearing action is performed (in this example, occurring between cutter disk 13, cutter disk 12, and another cutter disk mounted on the same shaft as cutter disk 12 and disposed on the opposite side of cutter disk 13 to cutter disk 12), whereby a strip is formed with the lower end free, as illustrated by chip 28 in FIG. 3. The next cutter tooth to meet this strip ( i.e. in this example, the next cutter tooth of cutter disk 13 ) perforates the sheet, forming a transverse slit therein, whereby the chip is completely separated from the waste material sheet. In this way, for example, chip 28 is formed. That is to say, the lower end of chip 28, as seen in FIG. 3, has been previously cut by the tooth on cutter disk 13 which immediately precedes cutter tooth 13*a*, while (at the instant illustrated in FIG. 3) the upper end of that chip is being formed by cutter tooth 13*a* entering the waste sheet. Chip 28 has at this stage been cut from the waste material sheet, and the chip clearance function now comes into operation. As described hereinabove, each cutter tooth is formed closely adjacent to a chip clearance protrusion, with the chip clearance protrusion of such a pair of protrusions being position leading the cutter tooth. The chip clearance function is performed in this example by the chip clearance protrusion ( denoted as 13*b*) which is paired with cutter tooth 13*a*. This chip clearance protrusion 13*b* pushes the waste material chip 28, cut out as described above, outward from the cutter mechanism, such as to eliminate the possibility of the chip becoming jammed between the rotating cutter disks. The chip then falls downward, clear of the cutter mechanism.

The above chip clearance function is illustrated by a chip 30, which has been cut out by adjacent cutter disk 12 acting in cooperation with cutter disk 13 and another cutter disk disposed on the opposite side of cutter disk 12 to cutter disk 13 and mounted on the same shaft as cutter disk 13. This chip 30 is shown as being pushed outward and downward to separate from the cutter mechanism, by a chip clearance protrusion 12*b* on cutter disk 12.

Although the cutting and chip removal operation has been described in the above for a single sheet of waste material, for simplicity of description, in actual practice a plurality of waste material sheets will be shredded simultaneously.

It can thus be understood from the above description that a waste material shredder according to the present invention effectively remove shredded chips from the cutter mechanism immediately after these chips have been formed, by means of chip clearance protrusions formed on the cutter disks of the cutter rollers, with the effectiveness of this chip clearance function being enhanced by a suitable shape for these chip clearance protrusions. It can be further understood that these chip clearance protrusions also serve to direct sheets of waste material in a manner ensuring efficient lateral perforation of the waste material sheets by the cutter teeth of the cutter rollers, thereby enhancing the efficiency of the overall shredding operation and reducing the power consumption of such a shredder.

Figure 4:
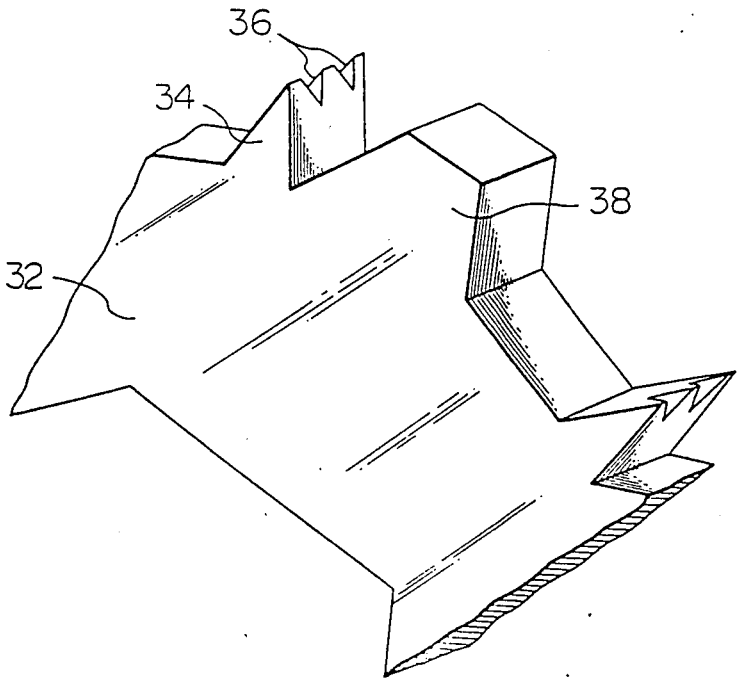
FIG. 4 is a partial oblique view of an alternative configuration for the cutter teeth of a waste material shredder according to the present invention.

FIG. 4 is a partial oblique view illustrating an alternative configuration of the cutter teeth of a waste material shredder according to the present invention, as compared with the chisel-shaped cutter teeth of the embodiment described above. In the embodiment of FIG. 4, triangular incisions 36 are formed in each of the cutter teeth 34 of a cutter disk 32, so that a plurality of sharp teeth are formed on each of the cutter teeth. Such a configuration for the cutter teeth is advantageous for certain types of waste material.

It should be noted that, in addition to the shape of the leading sloping edge of each of the chip clearance protrusions of the cutter disks of a shredder according to the present invention being an important feature thereof, the relative positions of the cutter disks of one cutter roller with respect to the cutter disks of the opposing cutter roller are also extremely important. More specifically, these relative positions must be arranged such that, as illustrated in FIG. 1, each of the cutter teeth of one cutter disk, e.g. each of teeth 13*a* of cutter disk 13, comes into position for perforating a waste material sheet at an instant when the central region of the leading sloping faces (e.g. 12*c*) of two chip clearance protrusions on the opposing cutter disks positioned on each side of the first-mentioned cutter disk are slightly overlapped by that opposing cutter tooth, i.e. the tip portion of the cutter tooth protrudes slightly between these two opposing leading faces. It has been found that this ensures highly effective shredding operation.

Although the present invention has been described in the above with reference to specific embodiments, it should be noted that various changes and modifications to the embodiments may be envisaged, which fall within the scope claimed for the invention as set out in the appended claims. The above specification should therefore be interpreted in a descriptive and not in a limiting sense.

What is claimed is:

1. A waste material shredding apparatus for converting sheets of waste material into small chips, comprising:

a supporting frame;

first and second counter-rotating cutter rollers;

mounting means for mounting said first and second cutter rollers in said supporting frame for rotation about respective axes thereof;

first and second sets of spacer plates fixedly mounted on said supporting frame;

said first and second cutter rollers comprising first and second roller shafts, respectively, disposed mutually parallel to each other, and first and second sets of cutter disks pointed coaxially along said first and second shafts, respectively, with adjacent ones of said first set of cutter disks being mutually separated by one of said first set of spacer plates, and adjacent ones of said second sets of cutter disks being mutually separated by one of said second set of spacer plates, first fixing means fixing said first set of cutter disks to said first shaft, second fixing means fixing said second set of cutter disks to said second shaft, said mounting means mounting said first and second cutter rollers on said supporting frame to provide a mutual interacting relationship between said first and second sets of cutter disks in which the relative position between said first and second sets of cutter disks is repeatedly the same for each revolution of said first and second sets of cutter disks, each of said cutter disks having an outer peripheral surface which is concentric with a corresponding one of said axes of rotation;

a plurality of pairs of protrusions on each cutter disk, with each pair being formed at regular spacings around said outer peripheral surface, each of said pairs comprising a cutter tooth and a chip clearance protrusion leading the cutter tooth of that pair with respect to the direction of rotation of said each cutter disk, each of said cutter teeth and each of said chip clearance protrusions protruding radially outward from said peripheral surface, each of said cutter teeth having a tip portion formed with a sharp cutting edge which is disposed substantially parallel to said axes of rotation, each of said chip clearance protrusions having a blunt surface as viewed along the direction of rotation, each of said chip clearance protrusions having a leading face leading said chip clearance protrusion with respect to the direction of rotation thereof, said cutting edge defining the outermost radial boundary of each cutter tooth, and said blunt surface defining the outermost radial boundary of each chip clearance protrusion, the radial distance between said outermost radial boundary of each cutter tooth and the axis of rotation of its respective cutter disk being substantially equal to the radial distance between said outermost radial boundary of each chip clearance protrusion and the axis of rotation of its respective cutter disk, said first and second fixing means and said mounting means providing said mutual interacting reationship so that each one of said cutter teeth on a first cutter disk on one roller shaft is repeatedly at a position in which the tip portion of said one cutter tooth overlaps a a pair of leading faces of a pair of chip clearance protrusions, respectively, formed on second and third cutter disks mounted on the other face of said roller shafts and disposed respectively on either side and closely adjacent to said first cutter disk, said overlapping relationship arising when said one cutter tooth on said first cutter disk and said pair of chip clearance protrusions on said second and third cutter disks are approaching one another, so that said pair of leading faces of said pair of chip clearance protrusions on either side of said one cutter tooth supports said waste material as said sharp cutting edge of said one cutter tooth penetrates said waste material to effect a cross-cut with minimal resistance and thereby produce a cross-cut waste chip;

the chip clearance protrusion on said first cutter disk which forms said pair of protrusions with said one cutter tooth and which leads said one cutter tooth in the direction of rotation of said first cutter disk being constructed to engage said waste chip which has just been cross cut and to push said just cut waste chip radially outwardly away from said one cutter tooth and downwardly to thereby remove the waste chip from the cutter apparatus, the aforesaid being sequentially repeated for each pair of cutter teeth and chip clearance protrusions on each cutter disk such as to preclude chip build-up and thereby provide jam-free operation.

2. A shredding apparatus according to claim 1, in which said cutting edge of each of said cutter teeth is of linear configuration in a direction parallel to the axes of rotation of said roller shafts.

3. A shredding apparatus according to claim 1, in which said cutting edge of each of said cutter teeth is formed with at least one V-notched portion therein.

4. A shredding apparatus according to claim 1, in which each of said chip clearance protrusions has a leading face which is disposed at an obtuse angle relative to a tangential line which is tangential to said peripheral surface where said leading face intersects said peripheral surface.

5. A shredding apparatus according in claim 1, in which each of said chip clearance protrusions is in the form of three sides of a trapezoid, one of said three sides constituting a leading face which extends outwardly from said peripheral surface, another of said three sides constituting a trailing face which extends outwardly from said peripheral surface, and the third of said three sides constituting an outer face which extends between outer terminating ends of said leading face and said trailing face.

6. A shredding apparatus according to claim 5, in which each of said cutter teeth has a tooth leading face and a tooth trailing face which are disposed in a V-shaped configuration with the juncture of said tooth faces forming said sharp cutting edge, said tooth leading face and the trailing face of the chip clearance protrusion of each respective pair being disposed in a V-shaped configuration.

7. A shredding apparatus according to claim 6, in which the juncture of the tooth leading face and the trailing face of the chip clearance protrusion of each respective pair is disposed substantially on said peripheral surface.

8. A shredding apparatus according to claim 1, in which each of said cutter teeth has a triangular configuration.

* * * * *